US007311614B2

(12) United States Patent
Kumamoto

(10) Patent No.: US 7,311,614 B2
(45) Date of Patent: Dec. 25, 2007

(54) GOLF CLUB HEAD

(75) Inventor: Tomio Kumamoto, Kobe (JP)

(73) Assignee: SRI Sports Limited, Kobe (JP)

( * ) Notice: Subject to any disclaimer, the term of this patent is extended or adjusted under 35 U.S.C. 154(b) by 313 days.

(21) Appl. No.: 11/102,791

(22) Filed: Apr. 11, 2005

(65) Prior Publication Data

US 2005/0233833 A1 Oct. 20, 2005

(51) Int. Cl.
*A63B 53/04* (2006.01)

(52) U.S. Cl. ..... 473/345; 473/349

(58) Field of Classification Search ..... 473/324–350
See application file for complete search history.

(56) References Cited

U.S. PATENT DOCUMENTS

| | | | | |
|---|---|---|---|---|
| 6,849,003 | B2 * | 2/2005 | Kumamoto | 473/305 |
| 2003/0032500 | A1 | 2/2003 | Nakahara et al. | |
| 2006/0063608 | A1 * | 3/2006 | Mori et al | 473/345 |

* cited by examiner

*Primary Examiner*—Sebastiano Passaniti
(74) *Attorney, Agent, or Firm*—Birch, Stewart, Kolasch & Birch, LLP

(57) ABSTRACT

A golf club head comprises a metallic main body provided with an opening, and a FRP part covering the opening. The FRP part has a layered structure comprising a plurality of layers each made of a resinous material reinforced with fibers, wherein the layers include a high-loss-tangent layer whose resinous material has a loss tangent tan δa of from 0.5 to 3.0.

24 Claims, 8 Drawing Sheets

GOLF CLUB HEAD

BACKGROUND OF THE INVENTION

The present invention relates to a golf club head composed of a metallic main body and a FRP part, more particularly to a layered structure of the FRP part.

In recent years, hollow metal wood-type golf club heads are widely used. In order to reduce the weight of such hollow head and to lower the center of gravity, a hybrid head whose main body is made of a metal material and provided in the crown portion with an opening covered with a light-weight FRP part have been proposed. According to common belief to decrease the energy loss at impact, a resinous material whose internal friction on deformation is small is usually used to make such a FRP cover.

In the recent wood-type golf club heads, on the other hand, there is a trend toward large head volume. Thus, the opening in the crown portion and the FRP cover also have a tendency to become large sized.

The face portion receives a large impulsive force when hitting a ball. As a result, the face portion leans back instantaneously, and the FRP cover is deformed and starts to vibrate. As the internal friction is small, the duration of vibrations becomes relatively long although it is absolutely short. The impulsive force superposed by such vibrations is felt as a large shock, sometimes being painful by the golfer's hands. Further, such a resinous material has a tendency to have a poor impact-resistance. Therefore, there is a high possibility that the FRP cover is broken or cracked in transport or in play.

SUMMARY OF THE INVENTION

It is therefore, an object of the present invention to provide a golf club head, in which an impulsive force transmitted from the club head to the player's hands is mitigated, and impact feeling can be improved, and further, shock absorbability can be improved to prevent the FRP part from being damaged by an external force.

According to one aspect of the present invention, a golf club head comprises a main body made of a metal material and provided with an opening, and a FRP part covering the opening and having a layered structure comprising layers each made of a resinous material reinforced with fibers, wherein the layers include a high-loss-tangent layer whose resinous material has a loss tangent tan δa of from 0.5 to 3.0. Here, the loss tangent is measured at a frequency of 10 Hz in a temperature range of from 0 to 10 deg. C.

Therefore, when compared with resinous materials conventionally used in FRP parts, the loss tangent of the high-loss-tangent layer is very large. As a result, the vibration energy received from the hit ball is effectively converted to a heat energy and the impulsive force transmitted to the player's hands is lessened. Further, even if an impulsive external force is directly applied to the FRP part, as the shock is mitigated by the high-loss-tangent layer, the impact resistance can be improved to prevent damages such as breakage and crack of the FRP part.

DESCRIPTION OF THE PREFERRED EMBODIMENTS

Figure 1:
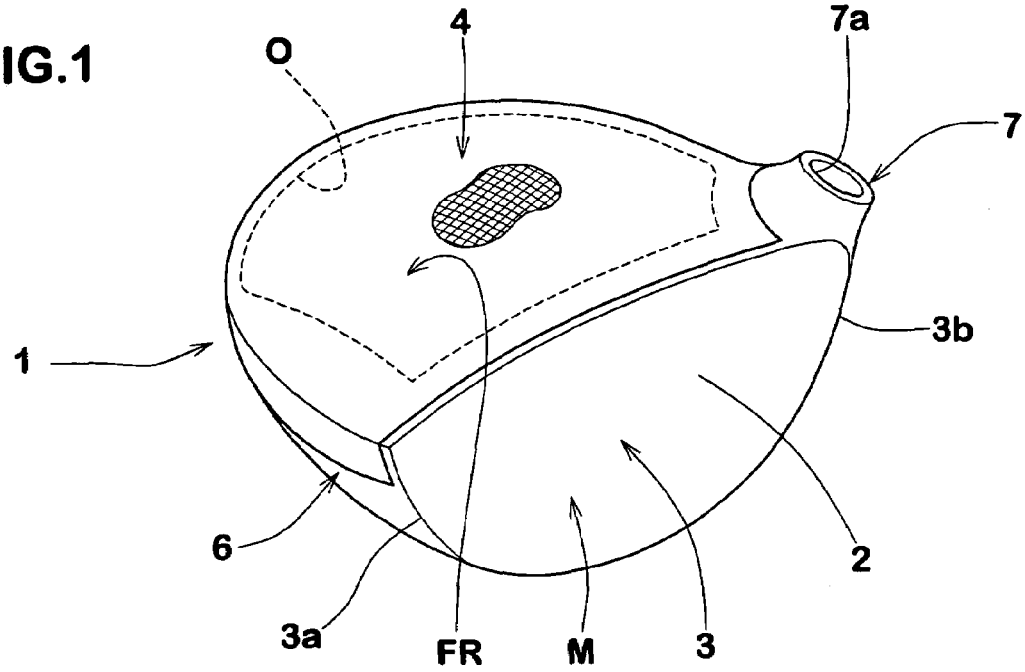
FIG. 1 is a perspective view of a wood-type golf club head according to the present invention.

Embodiments of the present invention will now be described in detail in conjunction with the accompanying drawings.

In the drawings, golf club head 1 according to the present invention is a wood-type hollow head such as for driver (#1) and fairway wood. The head 1 comprises: a face portion 3 whose front face defines a club face 2 for striking a ball; a crown portion 4 intersecting the club face 2 at the upper edge thereof; a sole portion 5 intersecting the club face 2 at the lower edge thereof; a side portion 6 between the crown portion 4 and sole portion 5 which extends from a toe-side edge 3*a* to a heel-side edge 3*b* of the club face 2 through the back face of the club head; and a hosel neck portion 7 to be attached to an end of a club shaft (not shown).

The head volume is set in a range of not less than 200 cc, preferably more than 250 cc, more preferably more than 270 cc, but not more than 460 cc, preferably less than 440 cc, more preferably less than 420 cc.

The club head 1 is composed of a hollow main body M made of at least one kind of metal material and provided with an opening O, and a FRP part FR covering the opening O and made of at least one kind of fiber reinforced resinous material.

Figure 5:
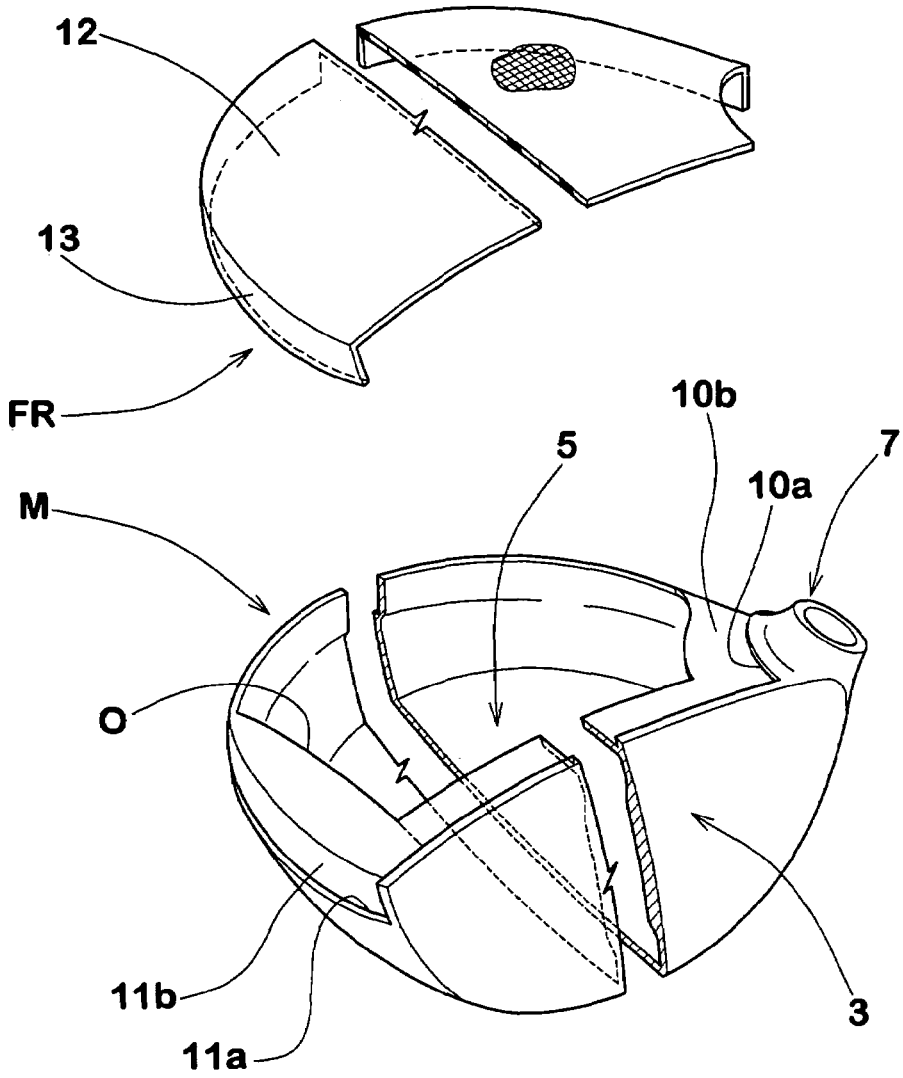
FIG. 5 is exploded perspective view of the club head.

In this example, the opening O is a single opening formed in the crown portion 4, and the FRP part FR forms a major part of the crown portion 4. Therefore, as shown in FIG. 5, the main body M includes the above-mentioned face portion 3, sole portion 5, side portion 6 and hosel neck portion 7.

The main body M is formed as an integral part such as casting. But, it is also possible to form the main body M by assembling/welding two or more parts formed by suitable methods, e.g. forging, casting, press working, rolling and the like. For example, stainless steel, maraging steel, pure titanium, titanium alloy, aluminum alloy, magnesium alloy, amorphous alloy and the like can be used to make the main body M. Preferably, metal materials having high specific tensile strength such as titanium alloy, aluminum alloy and magnesium alloy are used alone or in combination.

In this embodiment, the main body M is made of one kind of metal material, a titanium alloy Ti-6Al-4V, and formed by precision casting. In order to increase the flexure of the face portion 3 at impact, the maximum thickness of the face portion 3 is limited in a range of from 1.8 to 3.0 mm, preferably 2.1 to 2.9 mm, more preferably 2.3 to 2.9 mm. To further increase the flexure at impact without decreasing the durability and strength, the face portion 3 is preferably provided with a thinner peripheral region having a minimum thickness encircling a thicker central region in which the above-mentioned maximum thickness occurs. The thicker central region includes the centroid of the club face. The difference between the maximum and minimum is preferably in the range of from 0.1 to 1.5 mm.

The FRP part FR comprises a slightly convexly curved main portion 12 covering the opening O and defining the almost entirety of the outer surface of the crown portion 4. The FRP part FR is fixed to the main body M by the use of an adhesive agent or welding.

In order to increase the bonding area, the FRP part FR is provided with a turndown 13 along the edge of the main portion 12 excepting the face portion 3 and hosel neck portion 7. Further, the main body M is provided with a turnback 10*b* along the front edge, toe-side edge and heel-side edge of the opening O. The turnback 10*b* protrudes into the opening O to contact with the periphery of the inner surface of the main portion 12 of the FRP part FR, and the periphery and the turnback 10*b* are bonded. The turndown 13 extends downwards to contact with the uppermost zone 11*b* of the outer surface of the side portion 6 of the main body M, and the turndown 13 and the uppermost zone 11*b* are bonded. Thus, an overlap joint is formed around the opening O.

The width Wa of the overlap joint has to be at least 5.0 mm, preferably more than 10.0 mm to obtain a sufficient bonding strength. In view of the original purpose of weight reduction, the width Wa should be not more than 30.0 mm, preferably not more than 20.0 mm, more preferably not more than 15.0 mm. In order to decrease the overlap width Wa without deteriorating the bonding strength, the FRP part FR can be provided with the undermentioned two-forked part 26. The overlap width Wa may be measured along the outer surface of the main body in a direction perpendicular to a tangent to the edge of the opening.

If a portion of the turnback 10*b* extending along the upper edge of the face portion is too wide in the back and forth direction of the head, as the rigidity of this portion becomes high, the lean back motion of the face portion at impact is decreased and the improvement in the rebound performance owing to the resilience of the FRP part FR can not be obtained. In view of the rebound performance, therefore, it is preferable that the width Wf of this portion is not more than 20.0 mm, more preferably less than 15.0 mm.

At the boundary between the FRP part FR and main body M, the outer surface of the FRP part FR becomes flush with the outer face of the main body M. For that purpose, corresponding to the FRP part thickness, a down step 10*a* from the outer surface of the crown portion 4 and a down step 11*a* from the outer surface of the side portion 6 are provided. In this embodiment, as shown in FIG. 5, the down step 10*a* is formed near the front edge of the crown portion 4 and the distance therebetween is about 1 or 2 mm.

The FRP part FR has a layered structure comprising a plurality layers each composed of a resinous material and reinforcing fibers (f) embedded therein. The layers include: a high-loss-tangent layer Ra in which the matrix resin between the fibers has a loss tangent tan δa of from 0.5 to 3.0; and a low-loss-tangent layer Rb in which the matrix resin between the fibers has a loss tangent tan δb of not less than 0.01 and less than 0.5, when measured at a frequency of 10 HZ in a temperature range of from 0 to 10 deg. C.

Although all the FRP layers may be a high-loss-tangent layer Ra, it is preferable that at least one low-loss-tangent layer Rb is included in the layered structure so as to reduce the energy loss in totality to improve the rebound performance.

If the high-loss-tangent layer(s) Ra in the layered structure is less, in other words, if the low-loss-tangent layer(s) Rb is too much, it is difficult to control the vibrations. Therefore, the weight G1 of all the matrix resin in the high-loss-tangent layer(s) Ra is preferably set in a range of not less than 15%, more preferably not less than 18%, still more preferably not less than 20% of the weight of all the matrix resin in the FRP part FR.

Figure 6A:
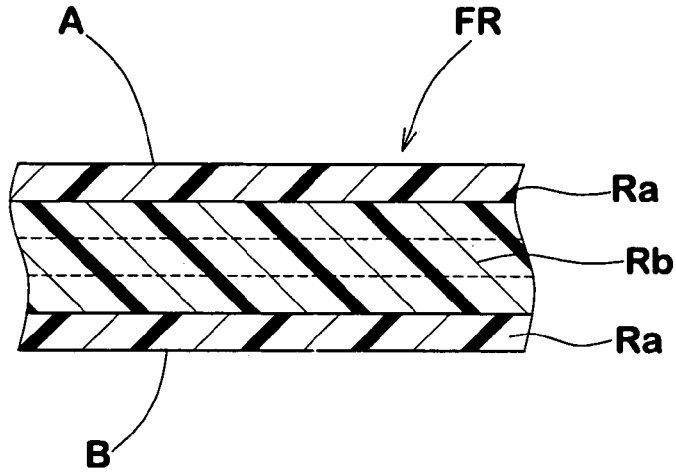
FIGS. 6*a*, 6*b* and 6*c* are enlarged cross-sectional views of part X of the FRP part shown in FIG. 3.
Figure 6B:
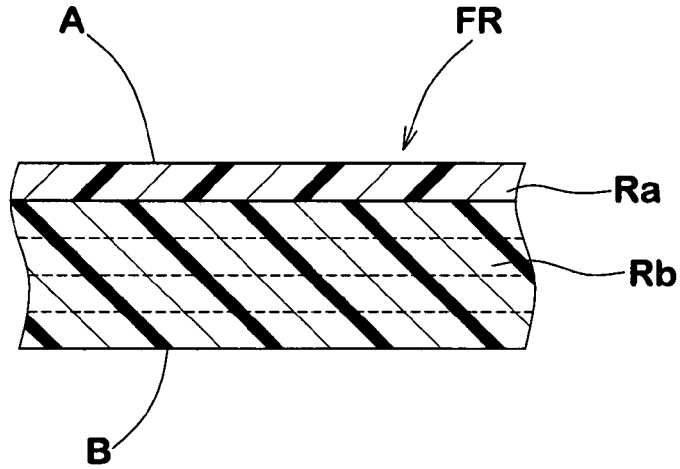
Figure 6C:
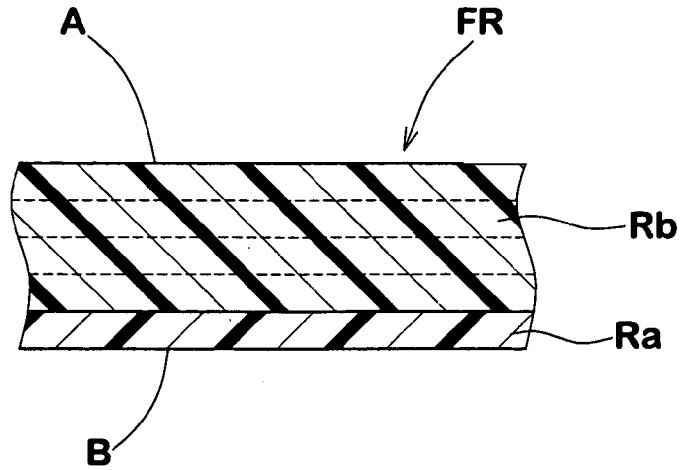

FIGS. 6*a*, 6*b* and 6*c* each show an example of the layered structure employed in the FRP part FR.

In the example shown in FIG. 6*a*, the outermost layer defining the outer surface (A) and the innermost layer defining the outer surface (B) are a high-loss-tangent layer Ra. Three low-loss-tangent layers Rb are interposed therebetween. If sectioned based on the loss tangents, the layered structure may be regarded as three layers of two thin layers and one thick middle layer.

In FIG. 6*b*, only the outermost layer defining the outer surface (A) is a high-loss-tangent layer Ra, and four low-loss-tangent layers Rb are disposed inside thereof.

In FIG. 6*c*, only the innermost layer defining the inner surface (B) is a high-loss-tangent layer Ra, and four low-loss-tangent layers Rb are disposed outside thereof.

Figure 7:
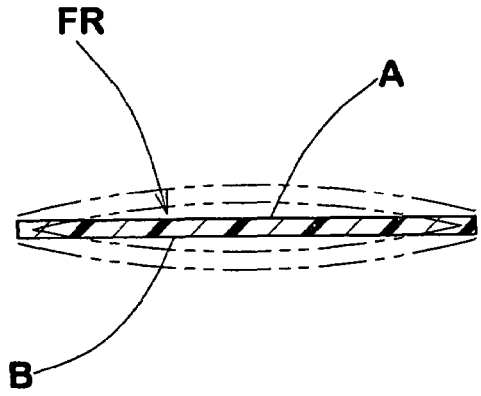
FIG. 7 is a diagram for explaining vibrations of a FRP part.

It is preferable that the high-loss-tangent layer Ra is provided as the outermost layer and/or the innermost layer as in the three examples. As shown in FIG. 7, when the FRP part FR vibrates at impact, the outer surface and the inner surface are subjected to a maximum compressive stress and maximum tensile stress alternately. Therefor, by disposing a high-loss-tangent layer Ra in such portion, a more efficient shock absorption is possible. Further, by disposing a high-loss-tangent layer Ra as the outermost layer, the impact-resistance can be improved.

As to the above-mentioned reinforcing fibers (f), carbon fiber, graphite fiber, glass fiber, alumina fiber, boron fiber, aromatic polyester fiber, aramid fiber, PBO fiber, amorphous metal fiber, titanium fiber and the like can be used alone or in combination within each layer. Especially, carbon fiber whose specific gravity is small for its high tensile strength is suitably used.

In this embodiment, the reinforcing fibers (f) are oriented in one direction or two orthogonal directions and have lengths long enough to extend across the FRP part. It is however also possible that one or more layers in the layered structure include short fibers (not shown) alone or in combination with the long oriented fibers (f).

If the tensile elastic modulus of the long oriented fiber (f) is too low, it is difficult to provide the FRP part FR with necessary rigidity and durability. If the tensile elastic modulus is too high, the tensile strength has a tendency to decrease. Therefore, the tensile elastic modulus is set in a range of not less than 50 GPa, preferably not less than 100 GPa, more preferably not less than 150 GPa, still more preferably not less than 200 GPa, but not more than 500 GPa, preferably not more than 450 GPa, more preferably not more than 400 GPa. The tensile elastic modulus is measured according to Japanese Industrial Standard (JIS) R7601:1986, "Testing method for Carbon fibers".

The resinous material of each layer Ra and Rb is composed of a resin base and additives when needed.

As to the resin base, heat-hardening resin such as epoxy resin, phenol resin, polyester resin and unsaturated polyester resin; thermoplastic resin such as polycarbonate resin and nylon resin; and the like can be used.

In the high-loss-tangent layer Ra, if the loss tangent tan δa is less than 0.5, it becomes difficult to absorb the vibrations effectively. If the loss tangent tan δa is more than 3.0, the formability or moldability becomes lowered, and as the energy loss at impact increases, the rebound performance is liable to deteriorate. Thus, the loss tangent tan δa is preferably set in a range of not less than 0.5, preferably more than 0.8, more preferably more than 1.0, but not more than 3.0, more preferably less than 2.8, still more preferably less than 2.5.

In the low-loss-tangent layer Rb, the loss tangent tan δb is set in a range of not less than 0.01, preferably more than 0.05, more preferably more than 0.1, but less than 0.5, preferably less than 0.4, more preferably less than 0.3. If the loss tangent tan δb is more than 0.5, the rebound performance has a tendency to decrease. If the loss tangent tan δb is less than 0.01, it becomes very difficult to obtain a necessary impact-resistance.

Further, in order to achieve shock absorption and rebound performance, the ratio (tan δa/tan δb) of the loss tangent tan δa to the loss tangent tan δb is preferably set in a range of not less than 1.2, more preferably more than 1.4, still more preferably more than 1.6, but not more than 2.5, more preferably less than 2.2, still more preferably less than 2.0.

As to the layer arrangement, aside from the above three examples, various arrangement may be possible. For example, two or more high-loss-tangent layers Ra having different values of the loss tangent can be used in one FRP part FR. In this case, it is preferable that the outer the layer position, the large the loss tangent.

In the high-loss-tangent layer Ra, an activator for increasing the loss tangent is added as an additive to the resinous material.

In this embodiment, epoxy resins, especially, which has an equivalent weight of 250 to 350, and a molecular weight of 500 to 700 are used as the resin base of the high-loss-tangent layer Ra. Specifically, a mixture of a polypropylene ether type epoxy resin and a G-glycidyl ether type epoxy resin is preferred. Such resin has relatively long main chains, and the side chains and cross-links are less. As a result, the loss tangent can be easily increased by increasing the amount of the activator added.

The above-mentioned activator is one or more chemical compounds selected from a group consisting of chemical compounds having a benzotriazole group and chemical compounds having a diphenylacrylate group. For example, so called dipole additives commercially available from CCI corporation under the tradename "Dipolgy DL26 and DL30" can be used as the activator.

In the resin base to which the activator is added, the electric dipoles provided by the activator are under a stable equilibrium state when the FRP part is under a static state. However, when the FRP part is vibrated, the electric dipoles in the resin are displaced from each other, and restoring forces occur on the dipoles. During restoring to an equilibrium state at that moment, the dipoles cause internal friction against the resin base (polymer chains) and also between the dipoles. Thus, the vibrations, namely, a mechanical energy can be converted into heat energy, and the vibrations are effectively damped. Thus, by changing the amount of the activator added, the loss tangent can be varied and adjusted to the desired value.

In the high-loss-tangent layer Ra, usually, 10 to 200 part by weight of the activator is added with respect to 100 part by weight of the resin base.

As to the low-loss-tangent layer Rb, on the other hand, the activator is not added to the resin base. But, as far as the loss tangent tan δa and tan δb satisfy the above-mentioned limitations, the activator may be added to the resin base of the low-loss-tangent layer Rb.

As to the resin base of the loss-loss-tangent layer Rb, the same resin as the high-loss-tangent layer Ra is used in this embodiment. But, an epoxy resin whose equivalent weight and molecular weight are smaller than those in the high-loss-tangent layer Ra can be preferably used.

In order to make the FRP part FR having such layered structure, various methods can be used.

In this example, by laminating and shaping a plurality of prepreg sheets P and curing the resultant laminate Ps under specific temperature and pressure, the FRP part FR is made.

The number of the prepreg sheets P is the same as the number of the layers Ra and Rb which is usually in a range of not less than 2, preferably not less than 3, more preferably not less than 4, but not more than 10, preferably not more than 8, more preferably not more than 6. In the above examples shown in FIGS. 6*a*, 6*b* and 6*c*, five sheets are laminated.

The prepreg is fiber reinforced resin sheet formed by impregnating the above-mentioned resinous material which is thermosetting with the reinforcing fibers.

The reinforcing fibers in each sheet can be in a form of: woven fabric in which the long fibers (f) are square woven; or unwoven fabric in which the long fibers (f) are oriented in two orthogonal directions; or unwoven fabric in which the long fibers (f) are oriented in one direction; or unwoven fabric in which short fibers are dispersed at random directions.

Figure 8:
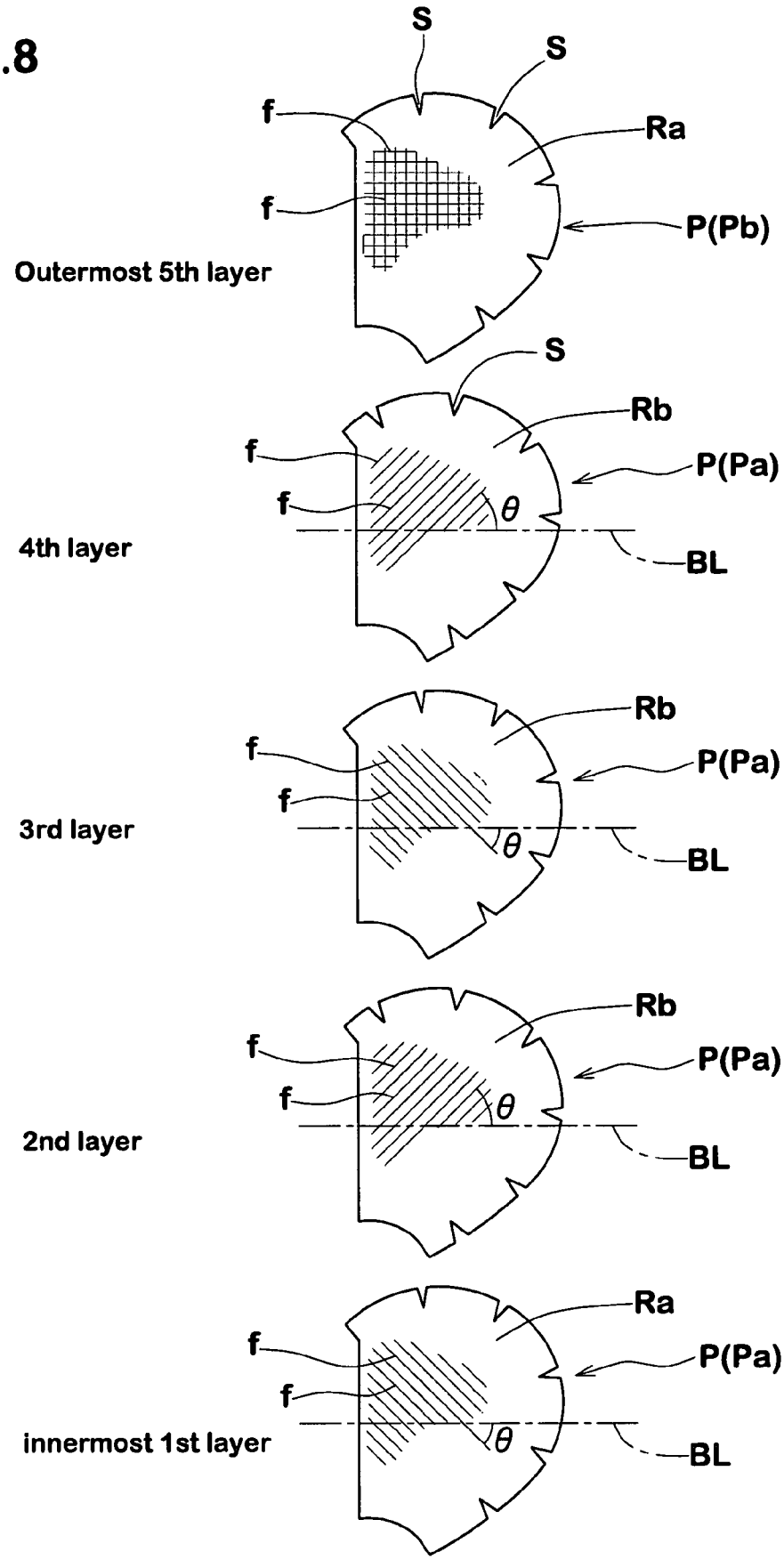
FIG. 8 shows an exemplary arrangement of prepreg sheets.

For example, in case of FIG. 6*a*, a preferable prepreg sheets arrangement is shown in FIG. 8. In this arrangement, the innermost 1st layer is a high-loss-tangent layer Ra, the outer 2nd layer is a low-loss-tangent layer Rb, the middle 3rd layer is a low-loss-tangent layer Rb, the 4th layer is a low-loss-tangent layer Rb, the outermost 5th layer is a high-loss-tangent layer Ra as explained above.

The outermost 5th layer is formed from bidirectional prepreg Pb (in this example square-woven prepreg) with the high-loss-tangent resinous material. The innermost 1st layer is on the other hand formed from unidirectional prepreg Pa with the high-loss-tangent resinous material. The 2nd, 3rd and 4th layers are each formed from unidirectional prepreg Pa with the low-loss-tangent resinous material.

Between the unidirectional prepreg sheets Pa, usually, the orientation directions or angles are differed from each other so that the fibers (f) in each layer cross those in the adjacent layers. More specifically, in case of the 1st-4th layers, the unidirectional prepreg sheets Pa are laminated such that their orientation directions θ become +45, −45, +45, −45 degrees with respect to the back and forth direction BL of the club head as shown in FIG. 8, namely, the orientation directions are orthogonal between the adjacent sheets Pa. In case of the 5th layer, the two orientation directions are 0 and 90 degrees. But, different angles for example a combination of +45 and −45 or others is possible. The use of the outermost square-woven prepreg Pb can prevent disarrangement of the reinforcing fibers (f) in the laminate which is very liable to occur during shaping and curing.

In the example shown in FIG. 8, the prepreg sheets P are first cut out from broad sheets, and in order to form the turndown 13 without crinkle, V-shaped slits S are provided such that between the adjacent sheets P, the positions of the V-shaped slits S do not coincide with each other.

In case where the FRP part FR manufactured separately from the main body M is bonded to the main body M, to make the FRP part, the prepreg sheets Pa and Pb are applied to a female die from the outermost layer to the inner most layer and pressurizing the inside of the laminate the laminate is heated to cure the resins. Then the hardened laminate is demolded and necessary trimming, surface treatment and the like are made, and the FRP part FR is fixed to the main body M by the use of an adhesive agent.

Figure 9A:
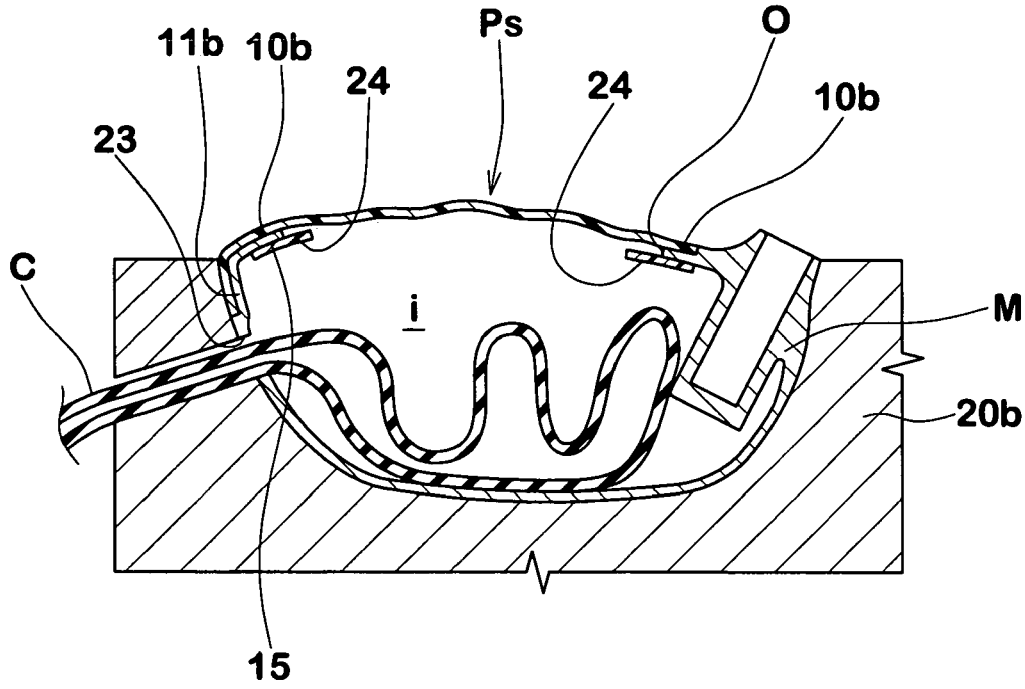
FIGS. 9*a* and 9*b* are cross sectional views for explaining a method of manufacturing the golf club head.
Figure 9B:
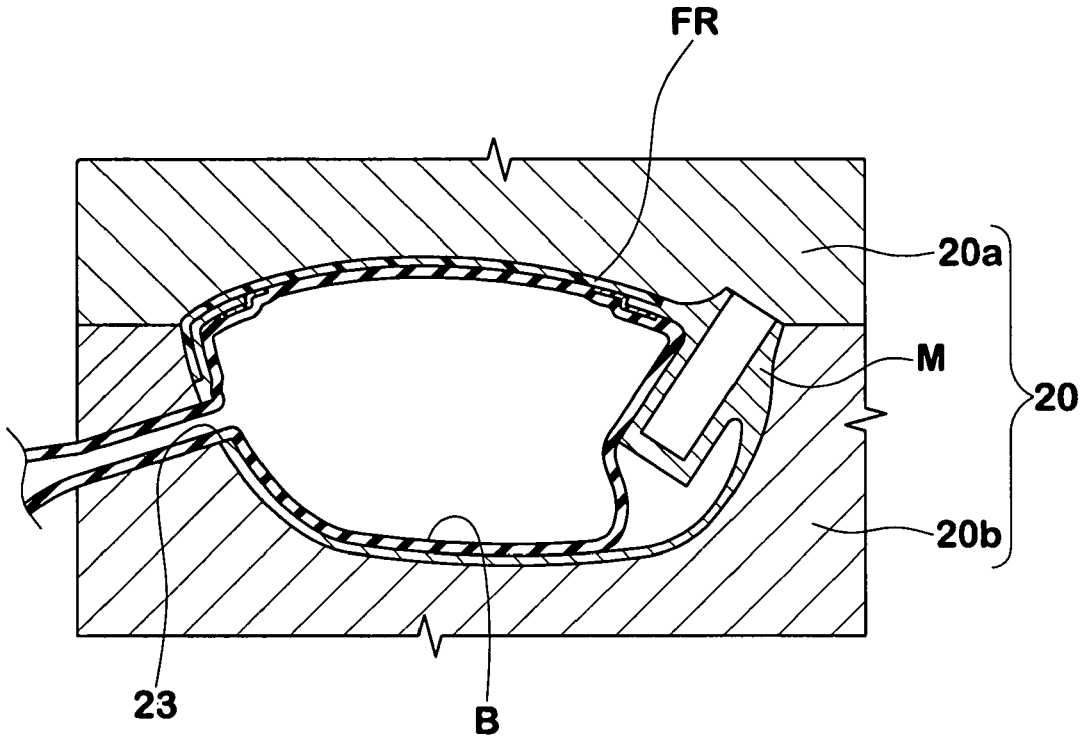

In this embodiment, another method is employed to manufacture the head, wherein the formation of the FRP part FR is carried out in parallel with the bonding to the previously formed main body M as shown in FIGS. 9*a* and 9*b*. First, the main body M is formed as explained above. The prepreg sheets P are applied to the main body M so that the opening O is covered with the laminate Ps. A heat-hardening adhesive agent or primer can be applied to the overlap-joint part 10*b* and 11*b*. The head is set in a mold 20 which for example comprises an upper die 20*a* and a lower die 20*b*. In the hollow (i) of the main body M, an inflatable bladder (c) is set in advance. As shown in FIG. 9*b*, the mold 20 is closed. While heating the mold, the bladder C is inflated using a through-hole 23 provided in the side portion 6 or others. Thus the laminate Ps is pressed onto the inside of the mold to be shaped and cured. As a result, the turnback 10*b* and the periphery of the main portion 12 are bonded. The turndown 13 and the uppermost zone 11*b* of the side portion 6 are bonded. The bladder C is contracted, and then using the through-hole 23, the bladder C is took out from the hollow (i). Thereafter, the through-hole 23 is closed by an appropriate cover such as badge, name plate and ornamental.

Figure 3:
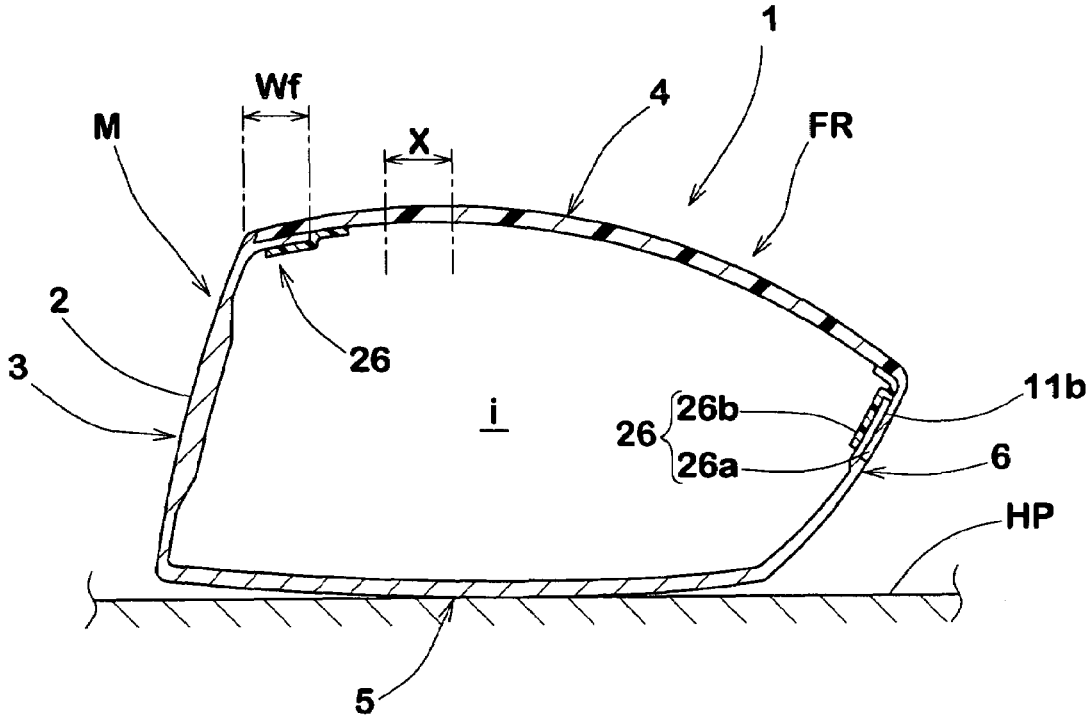
FIG. 3 is a cross sectional view thereof taken along line A-A in FIG. 2.
Figure 4:
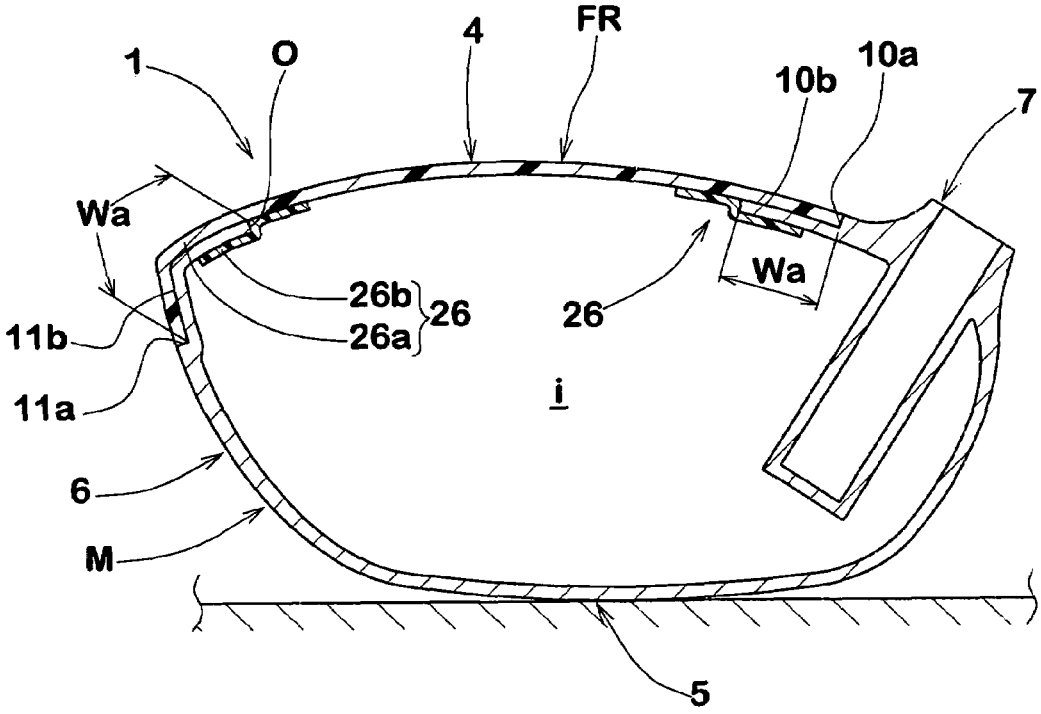
FIG. 4 is a cross sectional view thereof taken along line B-B in FIG. 2.

In this method, it is easy to provide an inner support portion 26*b* as shown in FIGS. 3 and 4.

Figure 10:
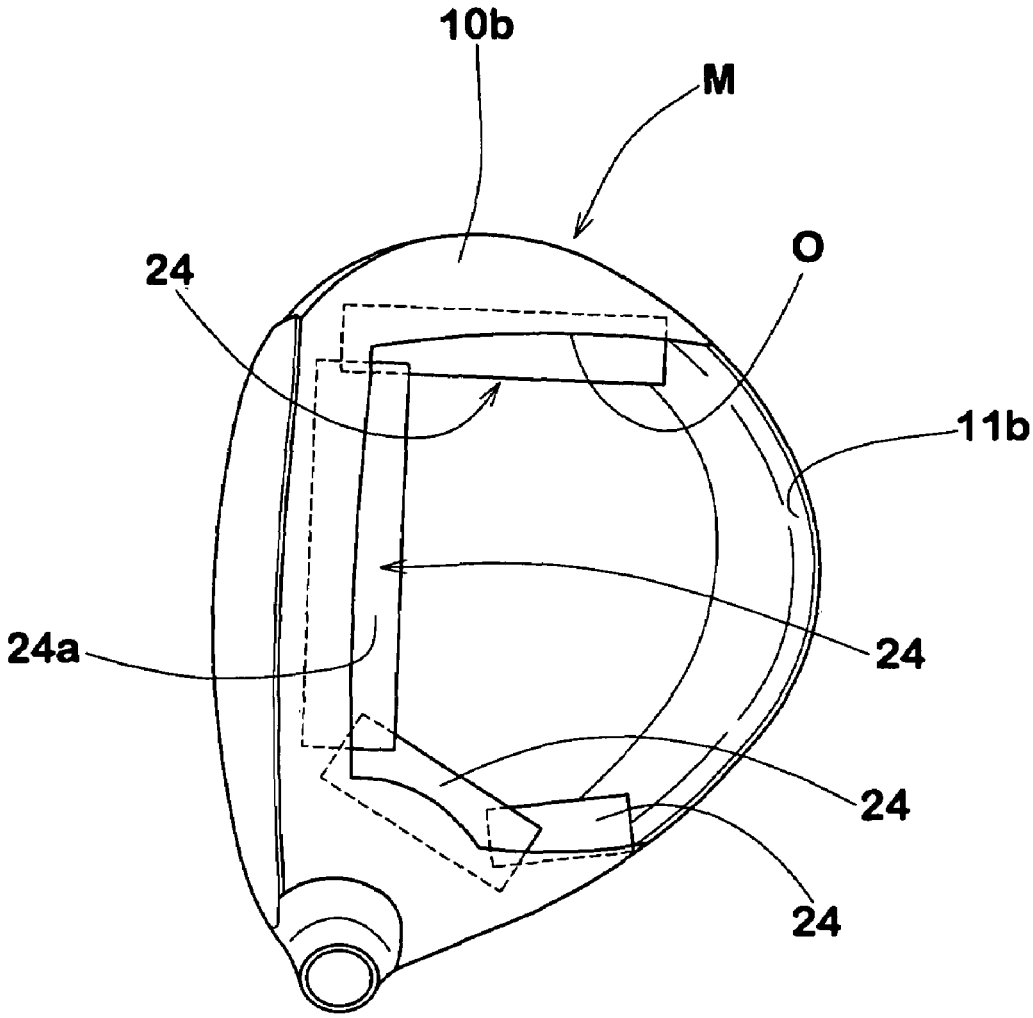
FIG. 10 is a top view of the head main body for explaining a method of manufacturing the golf club head.

Before applying the prepreg sheets P, a prepreg tape 24 is applied to the inside of the turnback 10*b* and uppermost zone 11*b* such that about a half width of the tape protrudes into the opening O as shown in FIG. 10 (In this figure, a prepreg tape 24 is not yet applied to the uppermost zone 11*b*). Thus the protruding part 24*a* is fusion bonded to the inside of the FRP part. Therefore, by the inner support portion 26*b* and the opposed portion 26*a* of the FRP part FR, a two-forked part 26 between which the turnback 10*b* and uppermost zone 11*b* are secured is provided along the edge of the FRP part FR.

In the above embodiment, the FRP part FR is employed to form only the crown portion. But, a FRP part may be employed to form further the sole portion or side portion. When the crown portion is formed by the FRP part FR and also the sole portion is formed by a FRP part in a similar manner as the crown portion, it is preferable that both the FRP parts include one or more high-loss-tangent layers Ra, but it may be also possible that one of the FRP parts includes one or more high-loss-tangent layers Ra.

Figure 2:
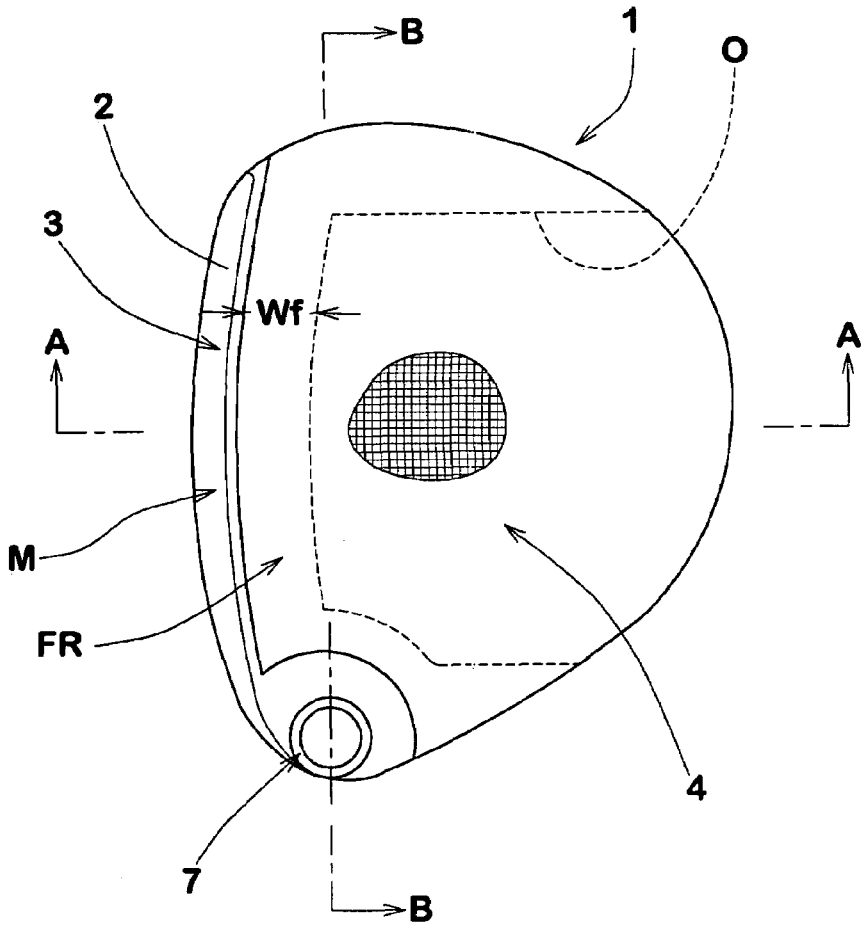
FIG. 2 is a top view thereof.

Comparison Tests 350 cc wood-type heads for #1 driver shown in FIGS. 1 and 2 were made by assembling a FRP part and a main body shown in FIG. 5, and tested for the rebound performance, impact resistance and impact feeling.

The main bodies M used were identical. The main body M was a casting of a titanium alloy Ti-6Al-4V formed by a lost-wax precision casting process.

The FRP part was formed as shown in FIGS. 9*a* and 9*b* by laminating five prepreg sheets. The allover thickness of the cured FRP part was about 0.8 to 0.9 mm. The reinforcing fibers were carbon fibers having a tensile elastic modulus of 240.3 GPa. The fiber orientation directions were as shown in FIG. 8, 0 & 90, +45, −45, +45, −45 degrees from the outside to inside. Only the loss tangents were changed by changing the amount of the activator added. The specifications are shown in Table 1. The resin base was bisphenol-A type epoxy resin. The activator was the above-mentioned dipole additive "DL26" manufactured by CCI corporation.

The loss tangent was measured under the following conditions, using with a viscoelasticity measuring apparatus manufactured by Rheology Co. Ltd.

Frequency: 10 Hz

Amplitude: plus/minus 12 micrometer

Temperature: 0 to 10 deg. C.

Initial elongation: 2 mm

Measurement mode: tensile

Heating rate: 2 deg. C./min

Sample size: width 5 mm, thickness 2 mm, and length 30 mm (effective length 20 mm)

Rebound Performance Test (Restitution Coefficient Test)

According to the "Procedure for Measuring the velocity Ratio of a club Head for conformance to Rule 4-1e, Appendix II, Revision 2 (Feb. 8, 1999), United States Golf Association", the restitution coefficient (e) of each club head was obtained. The results are shown in Table 1. The larger the value, the better the rebound performance.

Impact Resistance Test

Figure 11:
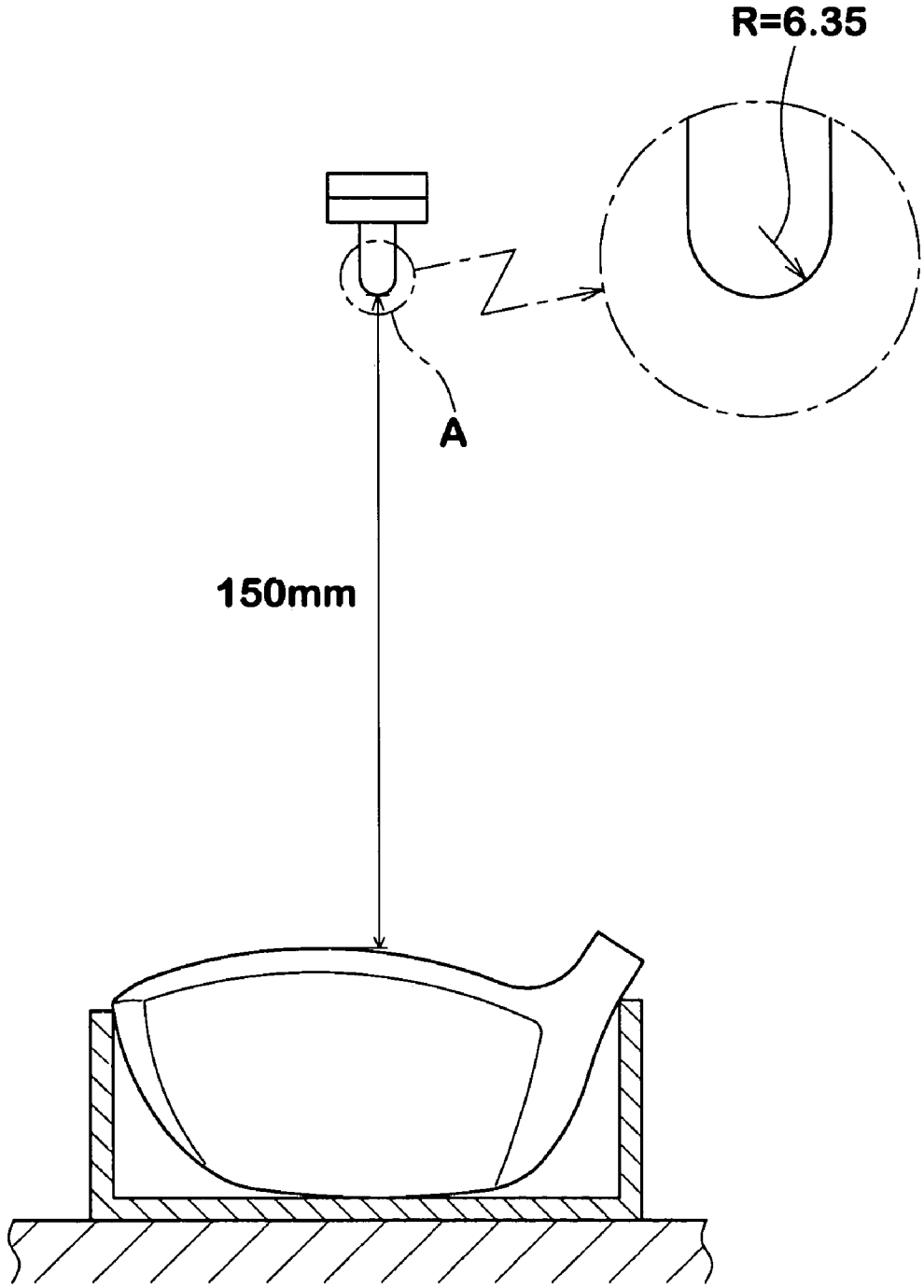
FIG. 11 is a diagram for explaining the impact resistance test.

As shown in FIG. 11, by letting a spindle free fall from a height of 150 mm from the crown portion, the end of the spindle collided with the center of the crown portion or FRP part three times. Then the head was checked for damage. The weight of the spindle was 500 grams, and the end of the spindle was rounded with a hemispherical surface having a radius R of 6.35 mm. The results are show in Table 1, wherein "no" means that no damage was found, and a numerical value means the number of times at which damage was caused.

Impact Feeling Test

The head was attached to an FRP shaft (commercially available from SRI Sports Ltd. under the tradename "XXIO MP300" flex=R) to make a 45-inch wood club. Ten golfers whose handicaps ranged from 5 to 20 evaluated the impact feeling of each club into three ranks "1", "2" and "3" after hitting golf balls (commercially available from SRI sports Ltd. under the tradename "XXIO") ten times per each club. The ranking number "3" means that the impulsive force transmitted to the hands was small and the impact feeling was good, "2" means average, and "1" means that the impulsive force was large and the impact feeling was not good. The results (the average of the ten golfers' rankings) are shown in Table 1.

TABLE 1

| Head | Ref. | Ex. 1 | Ex. 2 | Ex. 3 | Ex. 4 | Ex. 5 | Ex. 6 | Ex. 7 | Ex. 8 | Ex. 9 | Ex. 10 | Ex. 11 | Ex. 12 |
|---|---|---|---|---|---|---|---|---|---|---|---|---|---|
| Loss tangent | | | | | | | | | | | | | |
| 5th outermost layer | 0.3 | 0.5 | 0.6 | 1.2 | 2 | 0.3 | 1.2 | 0.3 | 1.2 | 1.2 | 0.6 | 2 | 2.7 |
| 4th layer | 0.3 | 0.3 | 0.3 | 0.3 | 0.3 | 0.3 | 0.3 | 1.2 | 0.1 | 0.4 | 0.6 | 2 | 2.7 |
| 3rd layer | 0.3 | 0.3 | 0.3 | 0.3 | 0.3 | 0.3 | 0.3 | 0.3 | 0.1 | 0.4 | 0.6 | 2 | 2.7 |

TABLE 1-continued

| Head | Ref. | Ex. 1 | Ex. 2 | Ex. 3 | Ex. 4 | Ex. 5 | Ex. 6 | Ex. 7 | Ex. 8 | Ex. 9 | Ex. 10 | Ex. 11 | Ex. 12 |
|---|---|---|---|---|---|---|---|---|---|---|---|---|---|
| 2nd layer | 0.3 | 0.3 | 0.3 | 0.3 | 0.3 | 0.3 | 0.3 | 0.3 | 0.1 | 0.4 | 0.6 | 2 | 2.7 |
| 1st innermost layer | 0.3 | 0.5 | 0.6 | 1.2 | 2 | 1.2 | 0.3 | 0.3 | 1.2 | 1.2 | 0.6 | 2 | 2.7 |
| δa/δb | — | 1.7 | 2 | 4 | 6.7 | 4 | 4 | 4 | 12 | 3 | — | — | — |
| Weight percent of High-loss-tangent resin to Overall resin | 10 | 18 | 20 | 20 | 20 | 18 | 22 | 22 | 40 | 20 | 100 | 100 | 100 |
| Restitution coefficient | 0.825 | 0.825 | 0.825 | 0.824 | 0.823 | 0.824 | 0.824 | 0.821 | 0.825 | 0.823 | 0.819 | 0.812 | 0.81 |
| Impact resistance | 3 | no | no | no | no | no | no | no | no | no | no | no | no |
| Impact feeling | 1.4 | 2 | 2.2 | 3 | 2.8 | 2.4 | 2.5 | 1.9 | 2.9 | 3 | 3 | 3 | 3 |

It was confirmed from the test results that the impact-resistance and impact feeling (shock absorbability at impact) can be improved without deteriorating the rebound performance.

The present invention is suitably applied to wood-type hollow heads. However, it is also possible to apply the invention to other types of heads such as iron-type, utility-type and patter-type as far as the head has a hollow structure.

The invention claimed is:

1. A golf club head having a hollow structure comprising a face portion, a crown portion, a sole portion and a side portion between the crown portion and sole portion, and constructed from a hollow main body made of a metal material and provided with an opening, and a FRP part covering the opening and made of at least one kind of resinous material and reinforcing fibers embedded therein, wherein said at least one kind of resinous material includes a high-loss-tangent resinous material having a loss tangent tan δa of from 0.5 to 3.0, and all the high-loss-tangent resinous material in the FRP part is not less than 15% in weight of said at least one kind of resinous material in the FRP part.

2. The golf club head according to claim 1, wherein said opening is provided in the crown portion.

3. The golf club head according to claim 2, wherein said FRP part forms an outer surface of the crown portion.

4. The golf club head according to claim 2, wherein said FRP part forms the substantially entire outer surface of the crown portion.

5. The golf club head according to claim 2, wherein said FRP part forms an outer surface of the crown portion and an outer surface of the side portion.

6. The golf club of claim 1, wherein the face portion has a thinner peripheral region having a minimum thickness encircling a thicker central region, said thicker central region having a maximum thickness within the range of 1.8 to 3.0 mm.

7. The golf club of claim 6, wherein the difference between the maximum and minimum thickness is from 0.1 to 1.5 mm.

8. A golf club head having a hollow structure comprising a face portion, a crown portion, a sole portion and a side portion between the crown portion and sole portion, and constructed from a hollow main body made of a metal material and provided with an opening, and a FRP part covering the opening and made of at least one kind of resinous material and reinforcing fibers embedded therein, wherein said FRP part has a layered structure comprising at least one high-loss-tangent layer made of a high-loss-tangent resinous material having a loss tangent of from 0.5 to 3.0 and reinforcing fibers embedded therein, and all the high-loss-tangent resinous material in the FRP part is not less than 15% in weight of said at least one kind of resinous material in the FRP part.

9. The golf club head according to claim 8, wherein said layered structure further includes a low-loss-tangent layer made of a low-loss-tangent resinous material having a loss tangent tan δb of not less than 0.01 but less than 0.5 and reinforcing fibers embedded therein.

10. The golf club head according to claim 9, wherein the loss tangent tan δa of the high-loss-tangent resinous material in the high-loss-tangent layer is at least 1.2 times the loss tangent tan δb of the low-loss-tangent resinous material in the low-loss-tangent layer.

11. The golf club head according to claim 8, 9, or 10, wherein said at least one high-loss-tangent layer is the outermost layer.

12. The golf club head according to claim 8, 9, or 10, wherein said at Jeast one high-loss-tangent layer is the innermost layer.

13. The golf club head according to claim 8, 9 or 10, wherein said at least one high-loss-tangent layer includes two layers, one is the outermost layer, and the other is the innermost layer.

14. The golf club head according to claim 8, wherein said opening is provided in the crown portion.

15. The golf club head according to claim 14, wherein said FRP part forms an outer surface of the crown portion.

16. The golf club head according to claim 14, wherein said FRP part forms the substantially entire outer surface of the crown portion.

17. The golf club head according to claim 14, wherein said FRP part forms an outer surface of the crown portion and an outer surface of the side portion.

18. The golf club head according to claim 8, wherein said layered structure includes: at least one layer whose reinforcing fibers are unidirectionally oriented; and at least one layer whose reinforcing fibers are bidirectionally oriented.

19. The golf club head according to claim 18, wherein said bidirectionally oriented reinforcing fibers are square-woven.

20. The golf club head according to claim 18, wherein the layer with the bidirectionally oriented reinforcing fibers is the outermost layer.

21. The golf club head according to claim 1 or 8, wherein the high-loss-tangent resinous material contains an activator for increasing the loss tangent of its base resin.

22. The golf club head according to claim 21, wherein said activator is at least one kind of chemical compound selected from a group consisting of: chemical compounds having a benzotriazole group; and chemical compounds having a diphenylacrylate group.

23. The golf club head according to claim 1 or 8, wherein the high-loss-tangent resinous material contains an activator for increasing the loss tangent of its base resin, and the base resin is an epoxy resin whose equivalent weight is 250 to 350.

24. The golf club head according to claim 23, wherein said activator is at least one kind of chemical compound selected from a group consisting of: chemical compounds having a benzotriazole group; and chemical compounds having a diphenylacrylate group.

* * * * *